US005467504A

United States Patent [19]

Yang

[11] Patent Number: 5,467,504

[45] Date of Patent: Nov. 21, 1995

[54] HINGE FOR A PORTABLE COMPUTER

[75] Inventor: A-Tso Yang, Taipei Hsien, Taiwan

[73] Assignee: Chiahuan Spring Co., Ltd., Taipei Hsien, Taiwan

[21] Appl. No.: 191,958

[22] Filed: Feb. 4, 1994

[51] Int. Cl.[6] ..... E05D 11/08

[52] U.S. Cl. ..... 16/342; 403/84; 403/146

[58] Field of Search ..... 16/337, 342, 305, 16/304, 307; 248/284, 291; 403/120, 146, 84

[56] References Cited

U.S. PATENT DOCUMENTS

| | | | |
|---|---|---|---|
| 5,010,983 | 4/1991 | Kitamura | 16/342 |
| 5,018,244 | 5/1991 | Hino | 16/342 |
| 5,037,231 | 8/1991 | Kitamura | 16/307 |
| 5,197,704 | 3/1993 | Kitamura | 16/305 |
| 5,219,240 | 6/1993 | Kitamura | 16/305 |

*Primary Examiner*—Lowell A. Larson
*Assistant Examiner*—Donald M. Gurley
*Attorney, Agent, or Firm*—Harness, Dickey & Pierce

[57] ABSTRACT

A hinge includes a first hinge leaf unit which has a positioning plate secured to the upper housing of a portable computer, two pivot plates secured to two ends of the positioning plate, and two pivot holes formed through the pivot plates. A second hinge leaf unit is secured to the lower housing of the portable computer and has a pivot pin which extends through the pivot holes. A sleeve is sleeved tightly on the pivot pin and provide friction between the sleeve and the pivot pin to locate the upper housing at a selected position relative to the lower housing. A resisting unit includes first and second torsion springs which are sleeved tightly on the sleeve and which are connected respectively to the pivot plates. When the upper housing is turned downward, the first torsion spring provides a returning force to arrest downward movement of the upper housing and is tightened on the sleeve to allow the sleeve to rotate synchronously with the upper housing. When the upper housing is turned upward, the second torsion spring provides a returning force to arrest upward movement of the upper housing and is tightened on the sleeve to allow the sleeve to rotate synchronously with the upper housing. Synchronous rotation of the sleeve and the upper housing loosens the torsion springs.

1 Claim, 4 Drawing Sheets

HINGE FOR A PORTABLE COMPUTER

BACKGROUND OF THIS INVENTION

1. Field of the Invention

The invention relates to a hinge, more particularly to a hinge for a portable computer so as to allow the monitor of the portable computer to be located effectively at a usable position for a long time.

2. Description of the Related Art

The improvement of this invention is directed to a conventional hinge, as shown in FIG. 1, which is attached to a portable computer (not shown) so as to allow the monitor of the portable computer to be opened to a usable position.

Generally speaking, the portable computer includes an upper housing which receives a monitor thereon, and a lower housing which receives a keyboard and a computer processing unit thereon. The upper housing is pivoted to the lower housing by the conventional hinge.

Referring to FIG. 1, the conventional hinge has a a first hinge leaf unit 70, a spring unit 80, and a second hinge leaf unit 90. The first hinge leaf unit 70 includes a plate body of a U-shaped cross section which has two opposite upright walls and a bottom wall that interconnects the bottom ends of the upright walls and that is mounted securely on the inner surface of the upper housing of the portable computer. Each of the upright walls of the plate body has a pivot hole 71 formed therethrough. The pivot holes 71 are aligned with each other. A lock bolt member 72 is erected securely on the bottom wall of the plate body. The second hinge leaf unit 90 includes an elongated positioning plate 91 which is connected threadably to the lower housing of the portable computer, and an elongated pivot pin 92 which extends through the pivot holes 71 of the first hinge leaf unit 70 so as to allow the first hinge leaf unit 70 to be mounted pivotally on the second hinge leaf unit 90. The spring unit 80 includes a generally U-shaped middle section 81 which is locked on the lock bolt member 72, and a pair of sleeve end sections 82 (only one is shown) which are sleeved tightly on the pivot pin 92 so as to provide a returning force and friction between the spring unit 80 and the pivot pin 92 for the upper housing when the first hinge leaf unit 70 moves with respect to the second hinge leaf unit 90. Both the returning force provided by the spring unit 80 and the friction between the spring unit 80 and the pivot pin 92 are capable of supporting the weight of the upper housing when the upper housing is opened to a usable location. A main disadvantage of this conventional hinge lies in the ease of elastic failure of the spring unit 80 due to long-term twisting deformation of the same, when applied to support the upper housing. Accordingly, the hinge cannot effectively support the upper housing at the usable location for a long time. In addition, because the sleeve end sections 82 of the spring unit 80 are rotated with respect to the pivot pin 92 repeatedly, the outer surface of the pivot pin 92 is worn down easily. This prevents the spring unit 80 from being sleeved tightly on the pivot pin 92. Accordingly, the returning force provided by the spring unit 80 and the friction between the spring unit 80 and the pivot pin 92 cannot support the weight of the upper housing of the portable computer at the usable location effectively.

SUMMARY OF THIS INVENTION

The main objective of this invention is to provide a hinge which is applied to a portable computer so as to allow the monitor of the portable computer to be located effectively at a usable position for a long time.

According to this invention, a hinge which is used for a portable computer includes a first hinge leaf unit, a second hinge leaf unit, a sleeve, and a resisting unit. The portable computer includes a lower housing and an upper housing which is pivoted to the lower housing by the hinge. The first hinge leaf unit includes a first elongated positioning plate portion adapted to be mounted securely on the upper housing, and a pair of pivot plate portions secured respectively to two ends of the first elongated positioning plate portion at the upper portions thereof. Each of the pivot plate portions has a pivot hole formed through the lower portion thereof. The second hinge leaf unit includes a second elongated positioning plate portion adapted to be mounted securely on the lower housing, and a pivot pin connected securely to an end surface of the second elongated positioning plate portion and extending through the pivot holes of the pivot plate portions of the first hinge leaf unit so as to allow the first hinge leaf unit to be mounted rotatably on the second hinge leaf unit. The sleeve is sleeved tightly on the pivot pin of the second hinge leaf unit so as to provide friction between the inner surface of the sleeve and the outer surface of the pivot pin, thus locating the upper housing at a selected position relative to the lower housing. The resisting unit includes a first torsion spring which is sleeved tightly on a portion of the outer surface of the sleeve and which has an end portion that is retained on one of the pivot plate portions so as to fasten the sleeve to the first hinge leaf unit in such a manner that the sleeve can rotate with the first hinge leaf unit, and a second torsion spring which is sleeved tightly on another portion of the outer surface of the sleeve and which has an end portion that is retained on the other one of the pivot plate portions. The returning force of the second torsion spring is capable of arresting upward movement of the upper housing relative to the lower housing. The second torsion spring is tightened on the sleeve when the first hinge leaf unit is turned upward so as to allow the sleeve to rotate synchronously with the first hinge leaf unit. Synchronous rotation of the sleeve and the first hinge leaf unit loosens the first torsion spring. The returning force of the first torsion spring is capable of arresting downward movement of the upper housing relative to the lower housing. The first torsion spring is tightened on the sleeve when the first hinge leaf unit is turned downward so as to allow the sleeve to rotate synchronously with the first hinge leaf unit. Synchronous rotation of the sleeve and the first hinge leaf unit loosens the second torsion spring.

BRIEF DESCRIPTION OF THE DRAWING

Other features and advantages of the present invention will become apparent in the following detailed description of a preferred embodiment of this invention, with reference to the accompanying drawings, of which.

DETAILED DESCRIPTION OF THE PREFERRED EMBODIMENT

Figure 3:
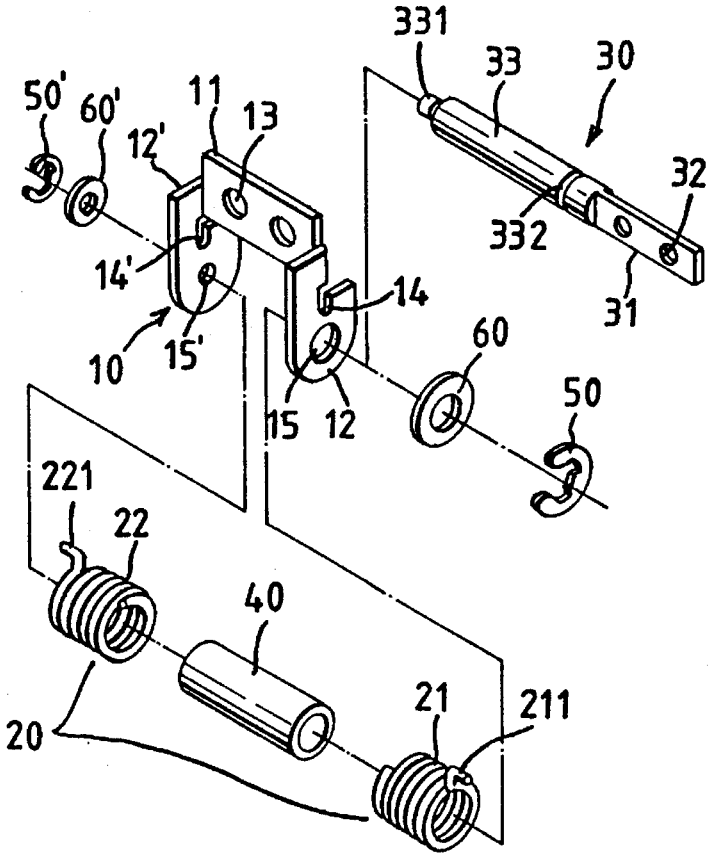
FIG. 3 is an exploded view showing the hinge of this invention.

Referring to FIG. 3, a hinge of the preferred embodiment of this invention, which is applied to a portable computer 70

Figure 4:
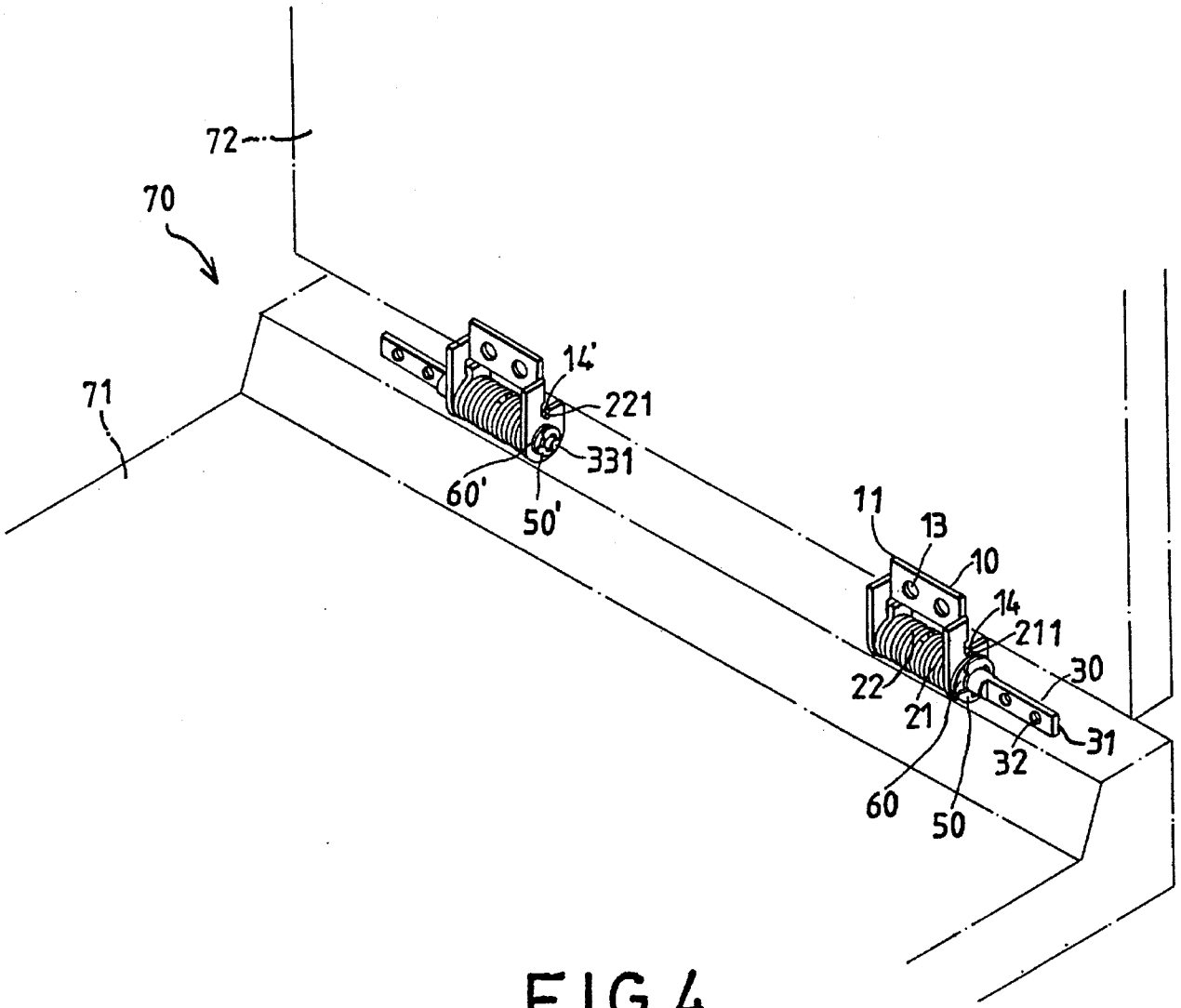
FIG. 4 is a schematic view illustrating a pair of hinges interconnecting the upper housing and the lower housing of the portable computer in accordance with this invention.

(see FIG. 4), includes a first hinge leaf unit 10, a resisting unit 20, a second hinge leaf unit 30, and a sleeve 40. The portable computer 70, as shown in FIG. 4, includes a lower housing 71 and an upper housing 72 which is connected pivotally to the lower housing 71 by means of a pair of hinges of this invention. The upper housing 71 can receive a monitor thereon. The lower housing 72 can receive a keyboard and a computer processing unit thereon.

Again, referring to FIG. 3, the first hinge leaf unit 10 includes a first elongated positioning plate portion 11 and a pair of pivot plate portions 12, 12' which are secured respectively to two ends of the first elongated positioning plate portion 11 at the upper portions thereof. The first elongated positioning plate portion 11 has two holes 13 formed therethrough so that the first elongated positioning plate portion 11 is connected threadably to the upper housing 72 (see FIG. 4) by two bolts (not shown). The right pivot plate portion 12 has a pivot hole 15 formed in the lower portion thereof and a notch 14 located above the pivot hole 15. The left pivot portion 12' has a pivot hole 15' formed in the lower portion thereof, and a notch 14' located above the pivot hole 15'. The diameter of the pivot hole 15 is larger than that of the pivot hole 15'.

The second hinge leaf unit 30 includes a second elongated positioning plate portion 31 and a pivot pin 33 which is mounted securely on an end surface of the second elongated positioning plate portion 31. The second elongated positioning plate portion 31 has two holes 32 formed therethrough so that the second elongated positioning plate portion 31 is connected threadably to the lower housing 71 (see FIG. 4) by two bolts (not shown). The pivot pin 33 has a small-diameter distal end 331 which has the same diameter as that of the pivot hole 15' so that, when the pivot pin 33 extends through the pivot hole 15, the distal end 331 can be engaged rotatably within the pivot hole 15', thereby allowing the first hinge leaf unit 10 to be mounted rotatably on the second hinge leaf unit 30. A circumferential groove 332 is formed in the curved surface of the pivot pin 33. Referring to FIGS. 3 and 4, a large-diameter ring 60 is sleeved on the pivot pin 33 outside the right pivot plate portion 12. A large-diameter C-shaped lock element 50 is mounted on the groove 332 of the pivot pin 33 outside the ring 60. A small-diameter ring 60' and a small-diameter C-shaped lock element 50' are sleeved on the distal end 331 of the pivot pin 33 outside the left pivot plate portion 12 in the same manner as the ring 60 and the lock element 50 in order to prevent removal of the second hinge leaf unit 30 from the first hinge leaf unit 10.

Figure 5:
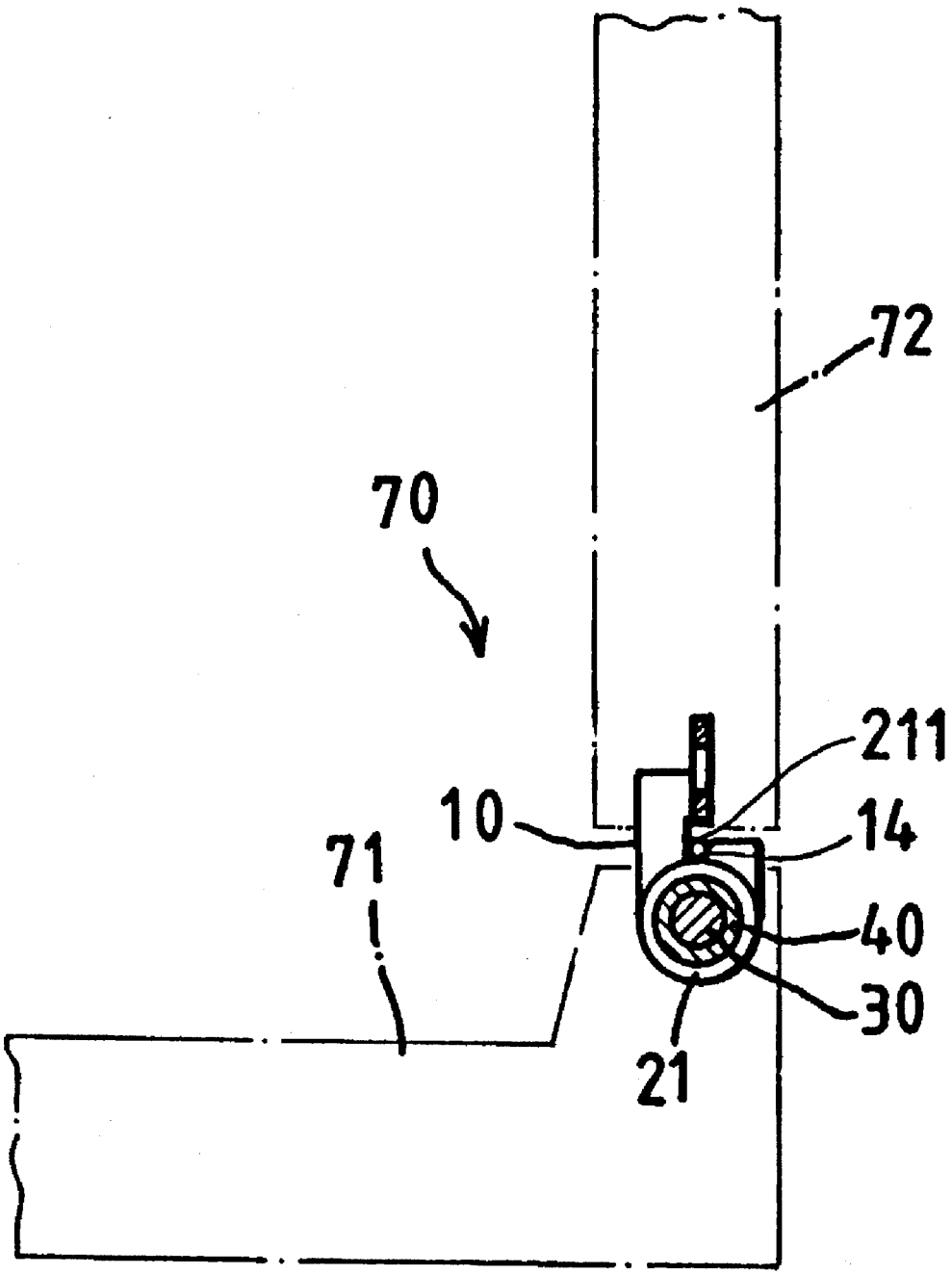
FIG. 5 is a sectional view illustrating the operation of the hinge according to this invention.

The sleeve 40 is sleeved tightly on the pivot pin 33 of the second hinge leaf unit 30 between the pivot plate portions 12, 12' of the first hinge leaf unit 10 so as to provide friction between the inner surface of the sleeve 40 and the outer surface of the pivot pin 33, thereby locating the upper housing 72 of the portable computer at a selected position relative to the lower housing 71, as shown in FIG. 5.

Figure 1:
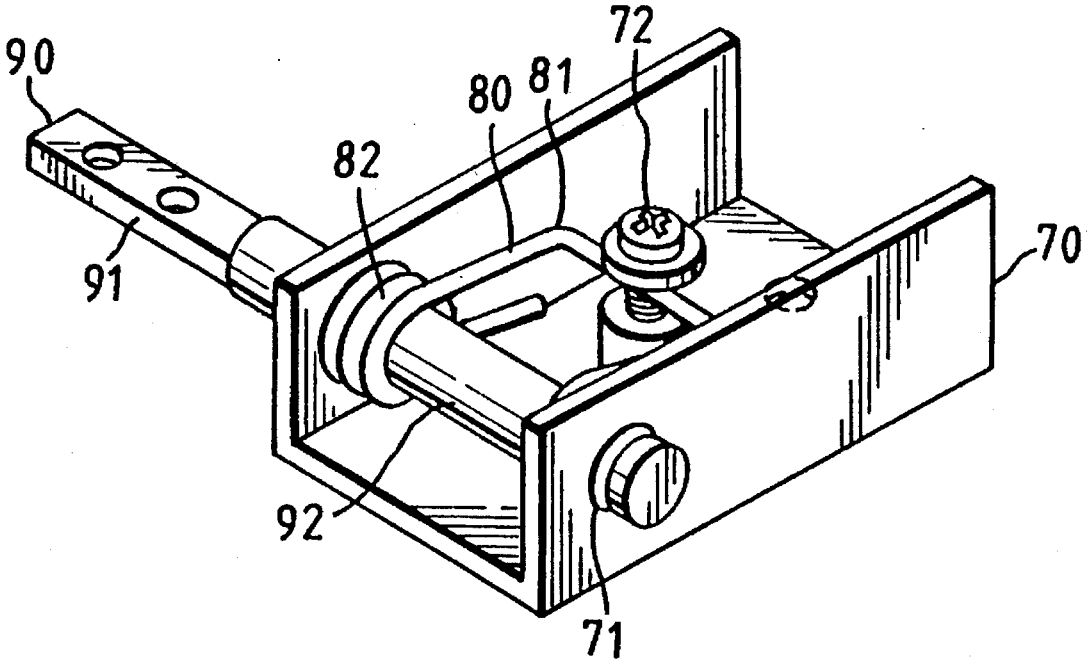
FIG. 1 PRIOR ART
FIG. 1 is a perspective view showing a conventional hinge which can be applied on a portable computer.
Figure 2:
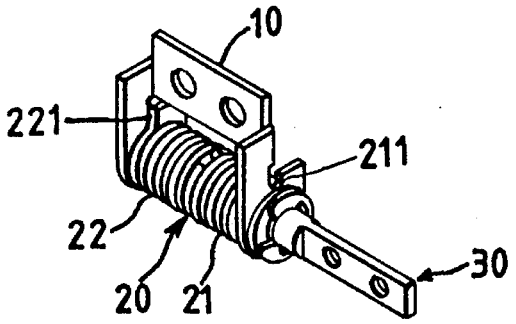
FIG. 2 is a perspective view showing a hinge of the preferred embodiment of this invention which can be applied on a portable computer.

Referring to FIGS. 2 and 3, the resisting unit 20 includes a first torsion spring 21 and a second torsion spring 22. The first torsion spring 21 is sleeved tightly on a portion of the outer surface of the sleeve 40 and has an end portion 211 that is retained on the notch 14 of the right pivot plate portion 12 so as to fasten the sleeve 40 to the first hinge leaf unit 10 in such a manner that the sleeve 40 can rotate with the first hinge leaf unit 10, and a second torsion spring 22 which is sleeved tightly on another portion of the outer surface of the sleeve 40 and which has an end portion 221 that is retained on the notch 14' of the left pivot plate portion 12'.

The returning force of the second torsion spring 22 is capable of arresting upward movement of the upper housing 72 relative to the lower housing 71. The second torsion spring 22 is tightened on the sleeve 40 when the first hinge leaf unit 10 is turned upward so as to allow the sleeve 40 to rotate synchronously with the first hinge leaf unit 10. Synchronous rotation of the sleeve 40 and the first hinge leaf unit 10 loosens the first torsion spring 21. The returning force of the first torsion spring 21 is capable of arresting downward movement of the upper housing 72 relative to the lower housing 71. The first torsion spring 21 is tightened on the sleeve 40 when the first hinge leaf unit 10 is turned downward so as to allow the sleeve 40 to rotate synchronously with the first hinge leaf unit 10. Synchronous rotation of the sleeve 40 and the first hinge leaf unit 10 loosens the second torsion spring 22.

Accordingly, when applied selectively on one of an opening motion and a closing motion for the upper housing 72, a force has to be larger than both the friction between the sleeve 40 and the pivot pin 33 and the returning force provided by the resisting unit 20 so as to allow the upper housing 72 to be located at a selected position. Owing to being provided only to arrest relative movement of the first hinge leaf unit 10 with respect to the second hinge leaf unit 30 and not to bias either leaf unit with respect to the other to a particular position, the first and second torsion springs 21, 22 do not suffer from elastic failure easily even though they are used for a long time. In addition, since the friction between the sleeve 40 and the pivot pin 33 is provided only to support the weight of the upper housing 72, the outer surface of the pivot pin 33 does not wear down easily. Accordingly, the sleeve 40 and the first and second torsion springs 21, 22 can be applied effectively on the portable computer for a long time.

With this invention thus explained, it is apparent that numerous modifications and variations can be made without departing from the scope and spirit of this invention. It is therefore intended that this invention be limited only as indicated in the appended claim.

I claim:

1. A hinge to be attached to a portable computer, said portable computer including a lower housing and an upper housing which is pivoted to said lower housing by said hinge, said hinge comprising:

a first hinge leaf unit including a first elongated positioning plate portion adapted to be mounted securely on said upper housing, and a pair of pivot plate portions secured respectively to two ends of said first elongated positioning plate portion at upper portions thereof, each of said pivot plate portions having a pivot hole formed in a lower portion thereof;

a second hinge leaf unit including a second elongated positioning plate portion which is adapted to be mounted securely on said lower housing, and a pivot pin which is connected securely to an end surface of said second elongated positioning plate portion and which extends through said pivot holes of said pivot plate portions of said first hinge leaf unit so as to allow said first hinge leaf unit to be mounted rotatably on said second hinge leaf unit;

a sleeve being sleeved tightly on said pivot pin of said second hinge leaf unit between said pivot plate portions of said first hinge leaf unit so as to provide friction between an inner surface of said sleeve and an outer surface of said pivot pin, thus locating said upper housing at a selected position relative to said lower housing; and a resisting unit including a first torsion spring which is sleeved tightly on a portion of an outer surface of said sleeve and which has an end portion that is retained on one of said pivot plate portions so as to fasten said sleeve to said first hinge leaf unit in such a manner that said sleeve can rotate with said first hinge leaf unit, and a second torsion spring which is sleeved tightly on another portion of said outer surface of said sleeve and which has an end portion that is retained on the other one of said pivot plate portions, said second torsion spring having a retaining force capable of arresting upward movement of said upper housing relative to said lower housing, said second torsion spring being tightened on said sleeve when said first hinge leaf unit is turned upward so as to allow said sleeve to rotate synchronously with said first hinge leaf unit, synchronous rotation of said sleeve and said first hinge leaf unit loosening said first torsion spring, said first torsion spring having a returning force capable of arresting downward movement of said upper housing relative to said lower housing, said first torsion spring being tightened on said sleeve when said first hinge leaf unit is turned downward so as to allow said sleeve to rotate synchronously with said first hinge leaf unit, synchronous rotation of said sleeve and said first hinge leaf unit loosening said second torsion spring, said first and second torsion springs cooperatively facilitating retaining of said upper housing in said selected position relative to said lower housing.

* * * * *